United States Patent [19]

Hahm

[11] Patent Number: 4,962,650

[45] Date of Patent: Oct. 16, 1990

[54] WINDING SUPPORT

[76] Inventor: Manfred Hahm, Ahornweg 17, 5100 Aachen, Fed. Rep. of Germany

[21] Appl. No.: 170,125

[22] Filed: Mar. 14, 1988

Related U.S. Application Data

[63] Continuation of Ser. No. 722,274, Apr. 11, 1985, abandoned.

[30] Foreign Application Priority Data

Apr. 11, 1984 [DE] Fed. Rep. of Germany ... 8411285[U]

[51] Int. Cl.[5] ..... D06B 17/02

[52] U.S. Cl. ..... 68/198; 68/189; 242/118; 242/118.11

[56] References Cited

U.S. PATENT DOCUMENTS

| | | | |
|---|---|---|---|
| 1,515,823 | 11/1924 | Benoit | 242/118.11 |
| 3,561,696 | 2/1971 | Hahm | 242/118.11 |
| 3,936,009 | 2/1976 | Livingstone | 242/118.11 |
| 4,181,274 | 1/1980 | Burchette, Jr. | 242/118.11 |
| 4,270,710 | 6/1981 | Ono | 68/198 X |
| 4,515,327 | 5/1985 | Ashley | 68/198 X |

FOREIGN PATENT DOCUMENTS

| | | | |
|---|---|---|---|
| 2408949 | 9/1975 | Fed. Rep. of Germany | 242/118.11 |
| 1492546 | 8/1967 | France | 242/118.1 |

*Primary Examiner*—Frankie L. Stinson

*Attorney, Agent, or Firm*—Herbert L. Lerner; Laurence A. Greenberg

[57] ABSTRACT

A winding support for the treatment of threads or yarns includes two end rings, a shell ring disposed between the end rings having openings formed therein, the shell ring including intermediate rings formed of a multiplicity of ring elements, and spacer elements disposed in the shell ring interconnecting the ring elements in axial direction, the ring elements having alternatingly larger and smaller diameters as seen in axial direction.

1 Claim, 5 Drawing Sheets

WINDING SUPPORT

This application is a continuation of application Ser. No. 722,274, filed Apr. 11, 1985, now abandoned.

The invention relates to a winding support for the treatment of threads or yarns, with two end rings, a shell ring having openings formed therein, and a multiplicity of elements forming intermediate rings, which elements may also be parts of at least one spiral, and spacer elements disposed in the shell ring and interconnecting said elements in axial direction.

Winding supports of the kind described above are in common use and have been proven excellent. Depending on their application, such winding supports must meet different requirements regarding space availability for the wound material. While being treated on the winding support, the wound material exerts a force upon the winding support, e.g. due to a shrinking process of the wound material, and the construction of the winding supports in the state of the art is such that they can yield to such an active force. At the same time, however, such winding supports must have breakthroughs which are as numerous and as large as possible in their deformed state, so that the dyeing liquid for dyeing the wound material which flows out of the dyeing spear or shaft, can penetrate the winding support from the inside to the outside while being as unhindered as possible.

Since the wound material acts differently while being treated on the winding support, depending on the kind of wound material and on the treatment, winding supports of a great variety of constructions which are deformable in axial direction or in radial direction or in both directions have become known in order to compensate for the tightening wound material. German Published, Prosecuted Application No. DE-AS 2,363,250 may be referred to as showing such a device. However, in this type of device the danger exists of threads of the wound material becoming caught as the winding support deforms, or even as it is being loaded. To prevent this, paper is always wound around such a winding support while in use. Furthermore, a winding support has become known from German Patent No. DE-PS 2,506,512 which, while not belonging to the type defined in detail above, has a winding body with convexities, between which depressions are formed, the winding body being deformable, at least axially. If the wound material shrinks due to a wet treatment or a heat treatment, this winding support makes it possible for the wound material to first find its way into the depression in radial direction, so that space is gained without the winding support deforming. However, if an axial deformation of the winding support occurs at the same time, the sliding of the wound material into the depressions is made easier on one hand, and the wound material is jammed in the depressions on the other hand. At the same time, the sum of the cross-sectional areas of the holes of the perforations account for only a small fraction of the total area for reasons of stability and the perforations hinder the passage of the dyeing liquid.

It is accordingly an object of the invention to provide a winding support which overcomes the hereinaforementioned disadvantages of the heretofore-known devices of this general type, which represents a sturdy support for winding the untreated material thereon, which has breakthroughs for the dyeing liquid that are as large as possible, and with which jamming of threads of the wound material does not occur.

With the foregoing and other objects in view there is provided, in accordance with the invention, a winding support for the treatment of threads or yarns, comprising two end rings, a shell ring disposed between the end rings having openings or perforations formed therein, the shell ring including intermediate rings formed of a multiplicity of ring elements, and spacer elements disposed in the shell ring interconnecting the ring elements in axial direction, the ring elements having alternatingly larger and smaller diameters as seen in an axial direction sequence.

In accordance with another feature of the invention, the ring elements are parts of at least one spiral. It has been shown that the wound material can be wound without difficulty over the larger diameters Since the above-described winding support structure provides a stable core on one hand and offers no noteworthy resistance to the dyeing liquid because of the narrow, rounded faces of the individual elements on the other hand, the desired properties of adequate stability and low resistance to the dyeing liquid are also obtained. The above-described sequence of the diameters of the elements forming the intermediate rings provides sufficient free space between the larger diameter elements which form the winding core of the untreated wound material, as it were, in radial direction and in axial direction, into which the wound material can move in reaction to a wet or heat treatment. Depending on the dimensions given for this free space and on the amount of wound material shrinkage, this may even obviate the deformability of the winding support in axial or in radial or in both directions.

In accordance with a further feature of the invention, the winding support has an outer or generated surface and/or it is cylindrical, conical, double-conical and/or wave-shaped, or a combination thereof. In this embodiment, the term "generated surface" represents the generatrix which the surface contour of the winding support generates when rotated about its longitudinal axis. On the other hand, the term "contour" describes the area generated by a generatrix placed over the winding support points located the furthest radially outwardly when rotated about the longitudinal axis of the winding support. Accordingly, this structure provides zones with different space availability in axial direction in one and the same winding support while retaining all other advantages. Therefore, especially in an only slightly deformable winding support, this structure retains all other advantages and prevents the jamming of threads of the wound material by selecting those shapes which meet the space requirements of the wound material to be treated in each individual case.

In accordance with an added feature of the invention, the ring elements include at least one group of ring elements spaced apart in axial direction having substantially the same diameter. It is possible through this group formation to vary and determine the size of the free spaces and the size of the outer winding surface where the winding support and the wound material make contact. In accordance with an additional feature of the invention, the at least one group is in the form of a plurality of groups, and including at least one other ring element disposed at least at one end of each of the groups having a larger diameter than the ring elements of the groups. This measure still provides a safe winding core with the greatest possible free space.

In accordance with again another feature of the invention, the other ring elements at each of the groups have substantially the same diameter, as compared to the ring elements of a group. This makes it possible, on one hand, to vary the available winding core surface, and on the other hand, to simultaneously vary both the shape of the contoured generated surface and the shape of the contour in a desired manner, without the fear that threads of the wound material will jam.

In accordance with again a further feature of the invention, the at least one group is in the form of a plurality of groups each having the same given contours, and the ring elements have circumferences or diameters disposed along the given contours. Since the elements forming the intermediate rings must be of different diameters, they can be divided into various diameter groups, with which they can then be coordinated at a particular contour. This envelope or contour then determines the diameter of the elements forming the intermediate rings and its change in the axial direction of the winding support. It is then possible to describe the winding support structure and fix the location and size of the free spaces by indicating the course of the contour coordinated with a particular group. A winding support constructed in this way also reliably avoids a jamming of wound material threads.

In accordance with again an added feature of the invention, the contours include a radially outermost contour, and the ring elements having circumferences disposed along the outermost contour include at least partly molded-in hollow parts with at least one open side. While retaining all other advantages and while avoiding jammings, this feature succeeds in making the winding support radially flexible, at least in vicinity of the outer winding core. Despite this radial flexibility, which provides additional clearance for a tightening of the wound material, jamming of wound material threads is still reliably prevented. Accordingly, an adaptation is made to different wound material requirements while simultaneously avoiding the danger of jamming.

In accordance with again an additional feature of the invention, the contours include a radially innermost contour, and including rigid spacer elements disposed axially one below the other relative to the axially adjacent elements, supporting at least the ring elements having circumferences disposed along the innermost contour. In this manner, a deformability in axial direction is prevented, at least for the winding support part located further back which provides space, so that this interspace will always stay open with certainty, thereby reliably precluding a jamming of wound material threads.

In accordance with yet another feature of the invention, the ring elements include thinner and thicker ring elements and the thicker ring elements have perforations or breakthroughs formed therein. This may result in a production simplification in certain cases and at the same time, it may generate a desired stability in axial direction at the points constructed in this way, which, however, remains limited to the respectively assigned axial areas.

In accordance with yet a further feature of the invention, the thicker ring elements are annular parts having inner and outer regions and U-shaped cross sections being open toward at least one of the regions. While providing basic axial stability, this nevertheless permits an axial deformation in the respective edge zones in a lesser order of magnitude. While avoiding the danger of wound material thread jamming, a special adaptation to specific requirements of certain types of wound material is achieved thereby.

In accordance with yet an added feature of the invention, the spacer elements support the ring elements and have radially outer concave surfaces. This is a particularly simple way of providing the desired jam-proof free space for the wound material.

In accordance with yet an additional feature of the invention, the spacer elements are soft in axial direction, rigid in axial direction or rigid and soft in axial direction at different axial locations. While retaining all former advantages, this feature makes it possible to meet the most varied requirements regarding the deformability of the winding support, and yet a jamming of wound material threads can be avoided at the same time.

In accordance with still another feature of the invention, the spacer elements have a greater deformation resistance in axial direction at the smaller diameter ring elements than at the larger diameter ring elements. This permits an axial deformalility of the entire winding support, assuming, however, different orders of magnitude as a function of the axial location. What is achieved by this structure in particular, is that the free spaces remaining for the wound material, upon an axial deformation of the winding support, deform less axially than the rest or the winding support components, so that a desired amount of axial deformation can be obtained with the most economical construction and yet jamming can be prevented.

In accordance with a concomitant feature of the invention, the spacer elements are mutually staggered or offset in circumferential direction, at least in axial sections of the spacer elements. Again, despite the elimination of the jamming danger, a winding support is created which is deformable both axially and radially and in which, when deformed axially, also automatically causes a radial deformation.

It is evident from the above-described embodiment that the invention provides a winding support which reliably prevents the jamming of threads of the wound material and yet can be constructed in such a way that its deformability meets all of the special requirements of the most varied wound material types. At the same time, an almost unhindered flowthrough of the dyeing liquid is made possible, as is already known from other winding supports in the state of the art.

Other features which are considered as characteristic for the invention are set forth in the appended claims.

Although the invention is illustrated and described herein as embodied in a winding support, it is nevertheless not intended to be limited to the details shown, since various modifications and structural changes may be made therein without departing from the spirit of the invention and within the scope and range of equivalents of the claims.

The construction and method of operation of the invention, how- . ever, together with additional objects and advantages thereof will be best understood from the following description of specific embodiments when read in connection with the accompanying drawings, in which.

Figure 1:
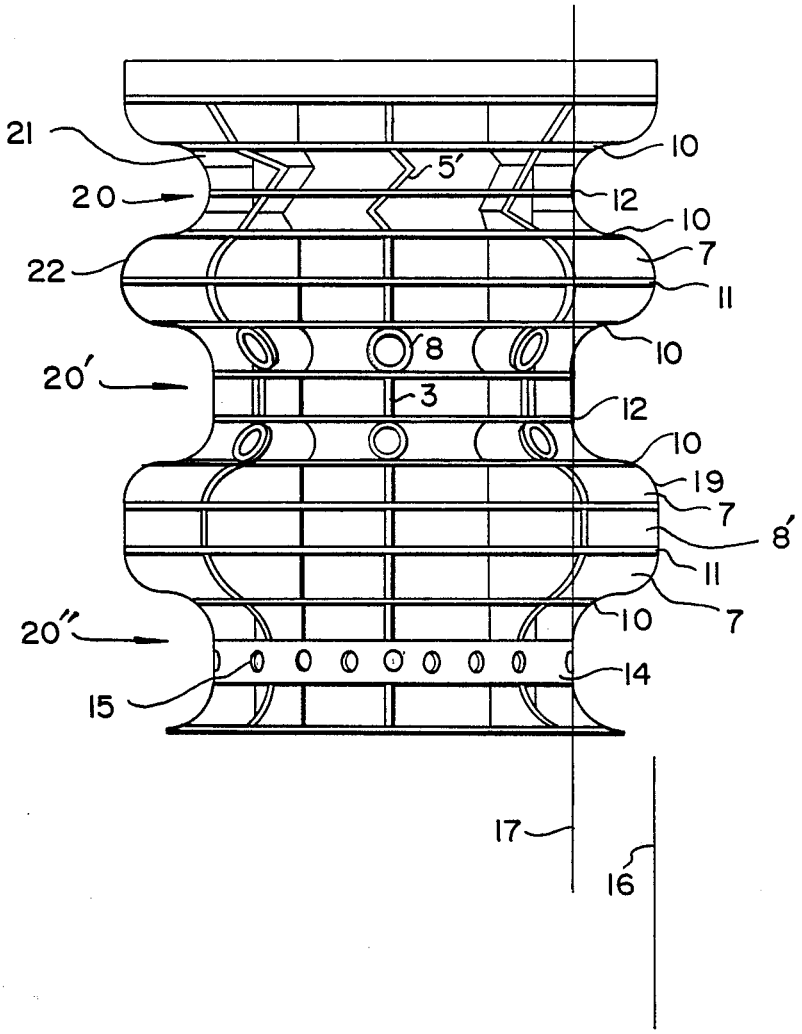
FIG. 1 is a diagrammatic, cross-sectional view of an axial part of a winding support with differently structured sections.

Referring now to the figures of the drawings in detail and first, particularly, to FIG. 1 thereof, there is seen a part of a winding support according to the invention in axial direction, in which different structural features are combined. This view can eliminate the need for many detail drawings. The structure deals with a winding support of the above-described type, in which ring elements which form intermediate rings of a shell ring between two end rings follow each other in axial sequence. The ring elements may also be parts of spirals. These elements are merely referred to as intermediate rings below for simplification, and they are given reference symbols 10, 11, 12 and 14. As viewed from top to bottom, an intermediate ring 10 is first seen, followed by an intermediate ring 12 with a smaller diameter. This smaller intermediate ring 12 is in turn followed by another intermediate ring 10. The ring 10 is followed by an intermediate ring 11 having a larger diameter. The smaller diameter intermediate ring 12 is spaced from the adjacent intermediate rings 10 by a spacer element 5'. The spacer element 5' is constructed in such a way that upon encountering a certain resistance, the intermediate rings 10 can move in axial direction toward the intermediate ring 12. In order to permit this axial motion of the intermediate rings, the spacer element 5' could, of course, have any other shape and configuration already known in the state of the art and suited for the purpose. The outer boundary surface 21 of the spacer elements 5' is concave or rounded so that a free space 20 is thus formed by the sequence of intermediate rings 10–12–10 and their spacer elements 5', in circumferential direction. The second intermediate ring 10 as viewed from the top is followed by an intermediate ring 11, which is followed in turn by an intermediate ring 10. The consecutive intermediate rings 10–11–10 are again mutually spaced apart by spacer elements 7, distributed in circumferential direction and disposed one below the other in the form of flat plates. For this purpose, the outer boundary surface 22 of these spacer elements 7 is convex in the illustrated embodiment, but any other shape may also be provided. This also applies to the corresponding shape of the other spacer elements. This spacer element shape provides axial rigidity. However, it makes sense, as a rule, for the spacer elements to be flexible in this area while conversely, as shown in FIG. 1, the spacer elements 5' are purposely rigid in axial direction, or at least more rigid than the spacer elements 7.

The outer contour formed by the periphery of the intermediate ring 11 and the outer boundary surface 22 of the spacer element 7 serves as a winding core which comes in contact with the inner threads of the wound material.

The intermediate ring 10 following the intermediate ring 11 is in turn followed by a group of two intermediate rings 12 which are located even further toward the inside, which have the smallest diameter and which lie on an innermost contour or outline 17 as does the first intermediate ring 12 described above, whereas the diameters of the intermediate rings 11 lie on an outer contour or outline 16.

The two intermediate rings 12, which are mutually adjacent in axial direction, are rigidly supported in axial direction by spacer elements 3 so that these two intermediate rings cannot move toward each other in axial direction This ensures a minimum size of a free space 20' to prevent threads of the wound material from becoming jammed.

The support between an intermediate ring 12 and the intermediate ring 10 adjacent thereto in axial direction, is accomplished by spacer elements 8. In the illustrated embodiment, the elements are tubular hollow parts so that an axial flexibility is obtained. The amount of this flexibility depends on the shape and wall thickness of these spacer elements 8. This kind of construction, in interaction with the intermediate ring group 10–11–10 disposed above it in axial direction and held rigid relative to each other in axial direction, can effect a certain desired sliding action through the spacer elements 8 upon an axial deformation, causing the threads of the wound material to dip into the free space 20'. In the process, the spacer elements 3 between the intermediate rings 12, which are rigid in axial direction, ensure that this area remains undeformed in axial direction, thereby securing a minimum free or open space, as already described.

Another modification of the winding support is disposed adjacent to the part described above. Adjacent and axially below the lower intermediate ring 10 which still interacts with the spacer elements 8, are two other intermediate rings 11 which also have outer peripheries that lie on the contour 16. These two intermediate rings 11 are mutually rigidly supported in axial direction by spacer elements 8'. Meanwhile, the group of elements formed of the two intermediate rings 11 rigidly supported in axial direction are supported toward the top and the bottom relative to the adjacent intermediate rings 10 by spacer elements 7 which are likewise rigid in axial direction. Naturally, such a construction is not restricted to two intermediate rings of the same diameter. This embodiment permits a change in the width of the winding core, so that the width of the winding core and the size of the free spaces 20 and 20', respectively, are balanced providing further improved safety against jamming. In particular, it is possible to build deformation elements into the intermediate rings 10 and/or 11, such as the hollow parts constructed as spacer elements 8, making these intermediate rings deformable in radial direction. If such elements are built into the intermediate rings 11, the winding core per se can thereby be reduced in size (the contour 16 can shift inwardly radially), or the corresponding radial deformation of the intermediate ring 10 enlarges the free space 20'. If, in combination, one adjacent intermediate ring 10 is equipped with such hollow parts and at the same time this intermediate ring 10 is supported relative to the adjacent intermediate ring 12 having a smaller diameter by such tubular spacer elements 8, the size of the free space 20' may be kept constant despite the spacer ring 12 and the spacer ring 10 moving closer together due to the radial deformability of the spacer ring 10. This, however, requires that care be taken to ensure that the spacer elements 7 do indeed permit such a radial deformation of the intermediate ring 10. However, these above-described features are not separately shown in the drawing because the preceding description in connection with the components already described with reference to FIG. 1 is fully sufficient for their comprehension.

Further below the part of FIG. 1 described so far, the intermediate ring 10 is adjoined by a thicker element 14 which acts as an intermediate ring and is completely rigid in axial direction, thereby determining a minimum size of a free space 20". The periphery of this thicker element 14 again lies on the contour 17. The thicker element 14 has perforations 15 directed therethrough from the inside to the outside for the passage of dyeing liquid, so as not to hinder the flowthrough of the dyeing liquid.

Figure 2:
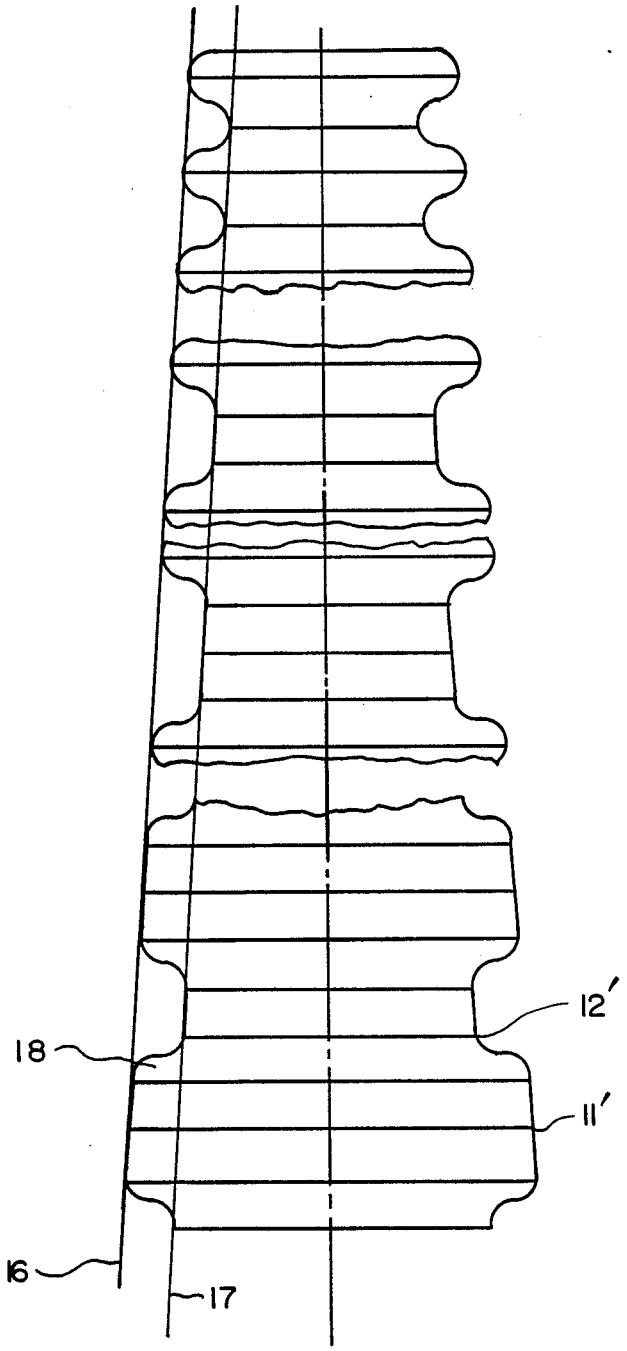
FIG. 2 is a fragmentary side-elevational view of a winding support.

A winding support of the kind described above is not only producible for cylindrical contours 16 or 17. Rather, the contours may assume any shape. FIG. 2, for example, diagrammatically illustrates one construction of such a winding support where mutually parallel contours 16 and 17 are tapered and only the intermediate rings 11', 12' are shown. However, the contours 16 and 17 by no means must be mutually parallel; these surfaces may also converge or diverge so that such a winding support may have a different deformation behavior in every axial zone, as viewed in axial direction, thereby permitting an exact adaptation to the specific characteristics of the particular material or goods to be wound.

It is also possible, as already described with regard to FIG. 1, to construct the winding support differently in different axial regions of the winding support, as diagrammatically shown in FIG. 1. Similarly and as a rule advantageously, a periodically or intermittently repeated structure is possible in axial direction. As already described, the different structural possibilities allow an adaptation to the various requirements of the material to be wound and also reliably avoid the danger of jamming threads of the goods to be wound.

Figure 3:
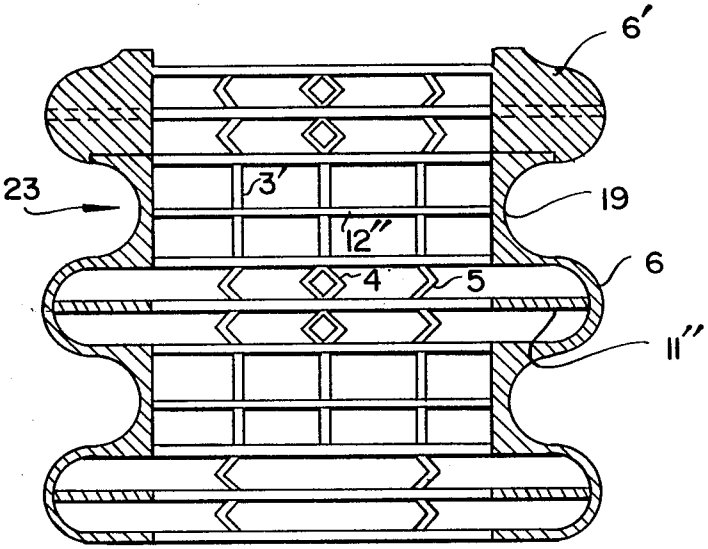
FIG. 3 is a fragmentary, longitudinal-sectional view of a specially constructed winding support.

Supplementing FIG. 1, FIG. 3 shows an axial section of a winding support sectioned lengthwise along a center plane. In the embodiment of FIG. 3, the shaded sectional plane may represent the plane of separation of a two-jaw mold to be used for the production of such winding supports. The intermediate rings 12" and 11" may be kept mutually spaced apart by different spacer elements, which in the embodiment are the spacer elements 3', 4, and 5. While the spacer elements 3' are disposed one below the other in axial direction and are rigid in this direction, the spacer element construction of the spacer elements 4 and 5, respectively, which are also disposed one below the other, provides axial flexibility. In the embodiment according to FIG. 3, all of the above-described spacer elements 3', 4, and 5 have unidirected generatrices or surfaces running in the direction of the opening motion of the mold jaws, i.e. perpendicular to the drawing plane. On the other hand, a contoured or enveloped spacer element 6 is provided in vicinity of the plane of separation on each side, which passes through from top to bottom and which has an outer contour that corresponds to a desired enveloping or contoured shell surface 19 in FIGS. 1 and 3 and 18 in FIG. 2, so that free spaces 23 can be created in this case as well, such as intermittently or repeatedly spaced free spaces. The resulting construction of the spacer element 6 ensures that in the area of the free space 23, i.e. the area covered by the intermediate rings 12", the spacer element 6 offers a higher deformation resistance in axial direction than in the area bulging outwardly which engages an intermediate ring 11". In the outwardly bulging area, the winding support is soft in axial direction. Therefore, this construction also ensures a free space 23 for the wound material, in which the wound material threads cannot jam, despite axial flexibility.

However, it is also possible to construct a winding support as in FIG. 3 which is entirely rigid in axial direction. The spacer element 6 located in the plane of separation must then assume the shape of the spacer element 6' in this area. The other spacer elements must then conform to the spacer elements 3' in location, disposition and construction. However, it is also possible, even while providing the spacer elements 6' in the plane of separation, to make the spacer elements soft in the planes which are turned through 90° relative thereto as in the spacer elements 4 or 5, as indicated in FIG. 3. This may be an advantageous way to generate different deformation resistances in different axial planes, thereby arriving at a particularly good adaptation to the wound material requirements, without the danger of wound material threads jamming.

Figure 4:
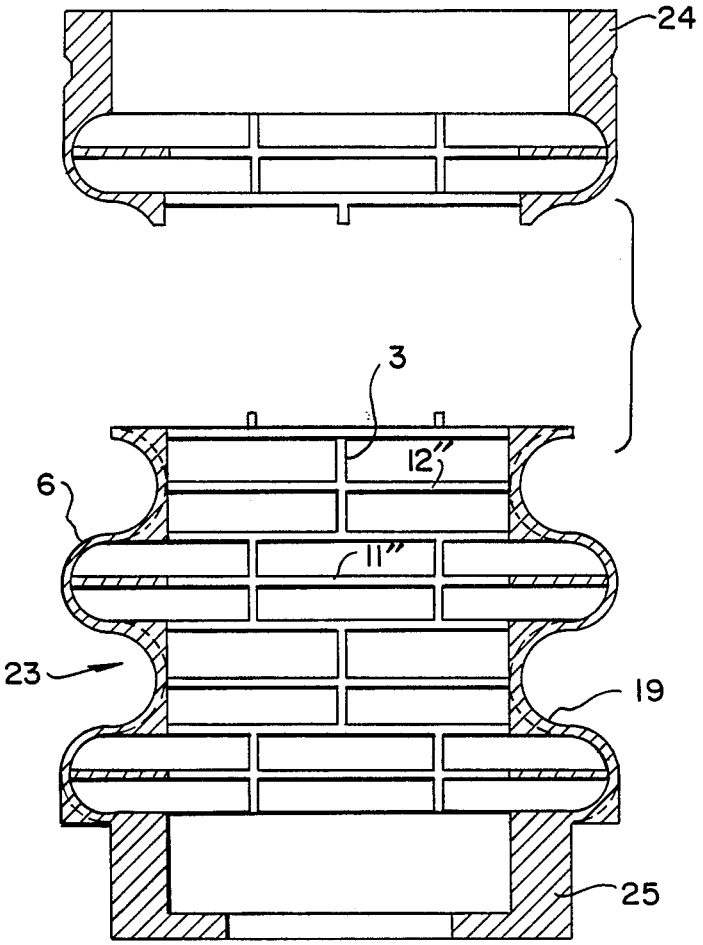
FIG. 4 is an exploded, longitudinal-sectional view of another special type of a winding support.

A winding support according to FIG. 3 may be equipped with ends 24 and 25, respectively, as shown in FIG. 4, by means of which several such winding supports can be placed on one dyeing spear and stacked on top of each other, with the coordinated surfaces making contact with each other. The part of the device shown in FIG. 4 which remains open, may be the part into which the part according to FIG. 3 is to be inserted. However, such a winding support according to FIG. 4 may also be automatically radially deformable upon axial deformation, by making a change in the axial disposition of the spacer elements 3. Such a structural embodiment is shown by the parts of a winding support illustrated in FIG. 4. The starting point of the embodiment according to FIG. 4 is the sectional plane already described in connection with FIG. 3, and regarding the generatrices or surfaces of the spacer elements 3 used in FIG. 4, the same disposition is chosen which was already described in connection with FIG. 3 so that a winding support according to FIG. 4 is also producible in a two-jaw mold.

In order to achieve an axial deformability with simultaneous, automatic, radial deformation of the winding support as in FIG. 4, all that is necessary is to stagger the spacer elements 3 relative to each other in circumferential direction. Upon axial deformation, this results in a wavy deformation of the intermediate rings, whereby their radial extent is reduced. Therefore, a radial deformation is automatically brought about simultaneously with an axial deformation. Nevertheless, the regions of the free spaces 23 offer a greater deformation resistance in axial direction than the other regions so that the danger of jamming is again eliminated.

It is also especially beneficial if the spacer elements 3 which are staggered in circumferential direction as shown in FIG. 4, are only staggered groupwise whereas the disposition within the groups is rigid in axial direction. In this way it is possible to carry out both an axial and a radial deformation of the winding support without the size of and spacings between the free spaces changing noticeably. All the winding support then does is to creep together only in its inner region, so to speak.

Figure 5:
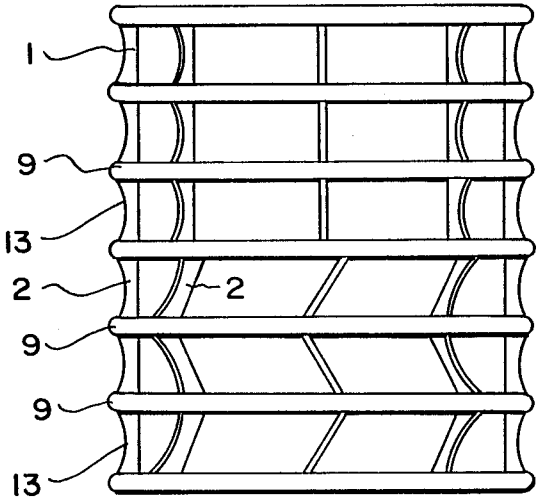
FIG. 5 is a side-elevational view of an axial part of a winding support, showing two features combined.

A particularly simple embodiment example is shown in FIG. 5. In FIG. 5, spacer rings 9 of the same diameter are provided, which are kept mutually apart in axial direction by spacer elements 1 and, in a variation which is also shown, are kept apart by spacer elements 2. The surfaces 13 of the spacer elements 1 and 2 facing radially outwardly are concave. This provides a particularly simple construction which creates a winding support that offers only very little flowthrough resistance to a dyeing liquid in the required manner, and which can offer sufficient room for shrinking processes for certain types of wound material with little axial motion, due to the concave surfaces 13.

The spacer elements 1 ensure that the winding support is relatively rigid in axial direction. An embodiment using the spacer elements 2 makes the winding support more flexible in axial direction. Upon an axial deformation of the winding support, this construction can even ensure that the intermediate rings 9 which keep the spacer elements 2 apart, perform a slight rotary motion relative to each other simultaneous with their axial motion, thereby promoting the sliding of the wound material threads into the concave surfaces 13.

Overall, the invention provides winding support structures which can be adapted to the greatest variety of deformation requirements, yet all of which prevent the jamming of wound material threads while at the same time permitting an almost unhindered flow-through of the dyeing liquid. Despite the above-described advantages, the other advantages of winding supports according to the state of the art are retained. This also applies to the adequate guidance of the winding support on the dyeing spear and to the stackability of several winding supports on the dyeing spear. By the same token, despite their advantages according to the invention, winding supports according to the invention are producible in a beneficial manner in two-jaw molds, so that in addition to all of the advantages described above, the advantage of a drastic simplification of the production molds can be achieved.

The foregoing is a description corresponding in substance to German application No. G 84 11 285.9, filed Apr. 11, 1984, the International priority of which is being claimed for the instant application, and which is hereby made part of this application. Any material discrepancies between the foregoing specification and the aforementioned corresponding German application are to be resolved in favor of the latter.

I claim:

1. Winding support for treatment of threads or yarns, comprising two end rings each having respective centers defining an axis; a shell ring disposed between said end rings having openings formed therein, said shell ring including intermediate rings formed of a multiplicity of ring elements; spacer elements disposed in said shell ring inter-connecting said ring elements in axial direction, said spacer elements having a dimension being greater in axial and in radial direction than in circumferential direction at least in the region of transition to a ring element, each intermediate and end ring having a perimeter disposed in a respective plane, the shell ring having a wavy surface as seen in the axial direction, and wherein said ring elements are spaced apart in axial direction and have circumferences disposed along a wavy contour, wherein said spacer elements are flexible in tangential direction.

* * * * *